US008635942B2

(12) United States Patent
Shibata

(10) Patent No.: US 8,635,942 B2
(45) Date of Patent: Jan. 28, 2014

(54) LIFTER STRUCTURE

(75) Inventor: Manabu Shibata, Nishio (JP)

(73) Assignee: OTICS Corporation, Aichi (JP)

( * ) Notice: Subject to any disclaimer, the term of this patent is extended or adjusted under 35 U.S.C. 154(b) by 663 days.

(21) Appl. No.: 12/946,119

(22) Filed: Nov. 15, 2010

(65) Prior Publication Data

US 2011/0116945 A1 May 19, 2011

(30) Foreign Application Priority Data

Nov. 17, 2009 (JP) ..... 2009-261618

(51) Int. Cl.
*F16J 1/10* (2006.01)

(52) U.S. Cl.
USPC ..... 92/129; 92/165 PR

(58) Field of Classification Search
USPC ..... 92/129, 165 PR; 74/569; 123/90.48
See application file for complete search history.

(56) References Cited

U.S. PATENT DOCUMENTS 5,743,223 A * 4/1998 Spengel et al. ..... 123/90.48

FOREIGN PATENT DOCUMENTS

JP 2009-236041 10/2009

* cited by examiner

*Primary Examiner* — Michael Leslie
(74) *Attorney, Agent, or Firm* — Smith, Gambrell & Russell, LLP.

(57) ABSTRACT

A lifter structure applied to an internal combustion engine and is actuated by a cam, includes a cylindrical lifter guide, a lifter body reciprocally moved in the guide while sliding on an inner circumferential surface of the guide, with drive of the cam, a pair of opposed walls continuous to an end of the lifter body, a pin extending through holes of the opposed walls and having two ends swaged onto outer surfaces of the opposed walls respectively, a roller disposed between the opposed walls, plural swaging side regions located at the same sides of the outer circumferential surface of the lifter body as the outer surfaces of the opposed walls, plural swaging side opposite regions located opposite the swaging side regions respectively, and plural escape recesses formed in the swaging side opposite regions so as to be spaced from the swaging side regions respectively.

12 Claims, 6 Drawing Sheets

LIFTER STRUCTURE

CROSS-REFERENCE TO RELATED APPLICATIONS

This application is based on and claims the benefit of priority from the prior Japanese Patent Application No. 2009-261618, filed on Nov. 17, 2009, the entire contents of which are incorporated herein by reference.

BACKGROUND ART

1. Technical Field

The present disclosure relates to a lifter structure.

2. Related Art

A lifter structure has conventionally been known which is used in a fuel pump pressurizing fuel fed from a fuel tank to supply pressurized fuel to an injector in vehicles, for example.

Japanese Patent Application Publication, JP-A-2009-236041, discloses a lifter structure including a cylinder, a plunger, a lifter guide and a lifter.

A lower end of the cylinder is connected via a spring seat to an upper end of the lifter guide. The cylinder is formed with a guide hole into which the plunger is inserted. The lifter guide also has a bore into which the lifter is inserted. The plunger has a lower end which faces the bore interior and is in abutment with the lifter. The lifter includes a lifter body, a pair of opposed walls continuous to a lower end of the lifter body, a roller disposed between the opposed walls, and a pin which extends through the roller, the opposed walls and has both ends swaged onto outer surfaces of the opposed walls respectively. The roller has an outer circumferential surface which is in abutment with a cam. Both lifter and plunger are biased to the cam side by a coil spring interposed between the lifer and the spring seat. A pump chamber is defined between an upper end of the plunger and the cylinder.

Upon rotation of the cam, the roller is rotated about the pin to drive the lifter upward. In this case, the lifter body is moved upward while sliding on an inner circumferential surface of the bore. With this, the plunger is also moved upward, whereupon the volume of the pump chamber is decreased (pressurization step). Upon further rotation of the cam, the lifter and the plunger are moved downward by the biasing force of the coil spring, whereupon the volume of the pump chamber is increased (suction step). The volume of the pump chamber is thus increased and decreased so that the fuel is sucked and discharged.

Both outer circumferential surface of the lifter body and inner circumferential surface of the bore have substantially truly circular sections respectively so that both surfaces are slidable on each other in the above-described conventional lifter structure. As a result, the lifter body is prevented from free motion (backlash) in the bore.

However, when both ends of the pin are swaged onto the outer surfaces of the opposed walls, an excessive swaging force is applied to the opposed walls. Accordingly, the walls sometimes fall down inward so as to come closer to each other. In this case, an adverse effect of deformation of the opposed walls reaches parts of the outer circumferential surface of the lifter body located at the same side as the opposed walls, whereupon the circularity of the outer circumferential surface of the lifter body cannot sometimes be maintained. More specifically, the lifter body includes first parts of the outer circumferential surface located at the same side as both opposed walls. Each first part of the lifter body will be referred to as "swaging side region." The lifter body also includes other or second parts of the outer circumferential surface located at a side perpendicular to both opposed walls. Each second part will be referred to as "non-swaging side region." In this case, the lifter body is sometimes plastically deformed so that the swaging side regions sometimes would bulge radially outward and so that the non-swaging side regions are degenerated radially inward.

Consequently, since an outer diameter of the lifter body between the swaging side regions exceeds an inner diameter of the bore, there is a possibility that the lifter body cannot be inserted into bore or that the lifter body may be forced into the bore. On the other hand, when an overall inner diameter of the bore is previously rendered larger in anticipation of deformation of the lifter body, a gap larger than an allowable one would be formed between the outer circumferential surface of the lifter body and the inner circumferential surface of the bore. The lifter body is would be rickety within the range of the gap, whereupon there is a possibility that a sliding friction may occur between the outer circumferential surface of the lifter body and the inner circumferential surface of the bore or abnormal noise may be produced.

SUMMARY

The disclosure provides a lifter structure that is applied to an internal combustion engine and is actuated by a cam, comprising a cylindrical lifter guide, a lifter body which is reciprocally moved in the lifter guide while sliding on an inner circumferential surface of the lifter guide, with drive of the cam, a pair of opposed walls which are continuous to an end of the lifter body and have respective through holes, a pin extending through the holes of the opposed walls and having two ends swaged onto outer surfaces of the opposed walls respectively, a roller which is disposed between the opposed walls so as to be rotated about the pin with drive of the cam while being in abutment with the cam, a plurality of swaging side regions that are located at the same sides of the outer circumferential surface of the lifter body as the outer surfaces of the opposed walls respectively, a plurality of swaging side opposite regions that are located opposite the swaging side regions of the inner circumferential surface of the lifter guide respectively, and a plurality of escape recesses which are formed in the swaging side opposite regions so as to be spaced from the swaging side regions respectively.

The deformation of the swaging side region due to the swaging of the pin is absorbed by the escape recesses. Consequently, the swaging side opposite regions and the swaging side regions can be prevented from interference with each other and accordingly, the assembly efficiency in assembling the lifter in the bore can be improved.

DETAILED DESCRIPTION

Figure 1:
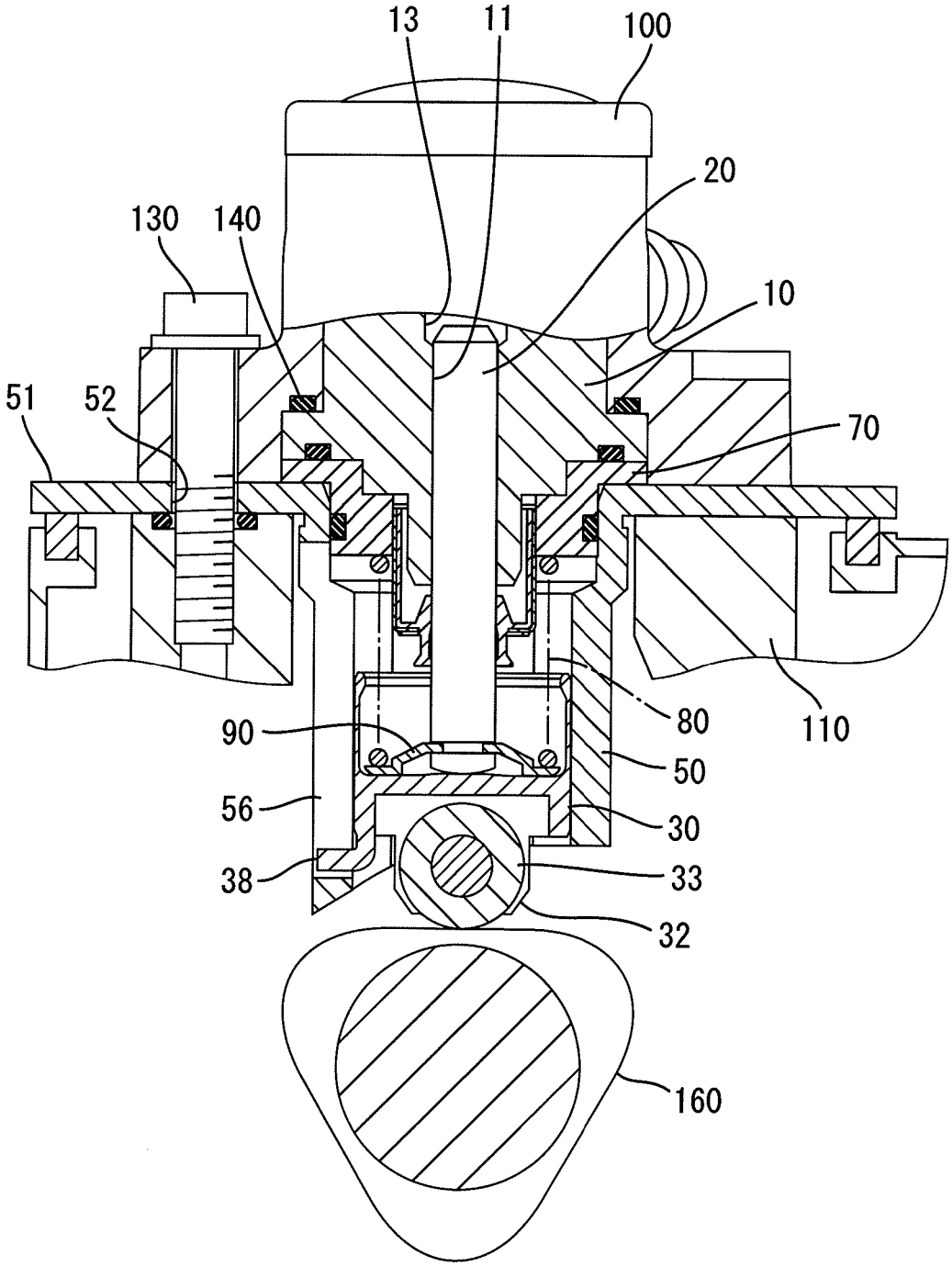
FIG. 1 is a sectional view of the lifter structure according to a first embodiment.

One embodiment will be described with reference to the accompanying drawings. Referring to FIG. 1, the lifter structure for a fuel pump is shown and includes a cylinder 10, a plunger 20, a lifter 30, a lifter guide 50, a spring seat 70, a coil spring 80 and a retainer 90.

A cover 100 is mounted over the cylinder 10, and a housing 110 is mounted below the cylinder 10. The spring seat 70 and the lifter guide 50 are disposed between the cylinder 10 and the housing 110. The cover 100 and the housing 110 are connected to each other by a bolt 130 extending through a flange 51 of the lifter guide 50, whereupon the cylinder 10 and the lifter guide 50 are fixed between the cover 100 and the housing 110 with the spring seat 70 being interposed between the cylinder 10 and the lifter guide 50. Seal rings 140 are interposed between joint surfaces of the parts for the purpose of liquid-tight sealing.

The cylinder 10 has a guide hole 11 extending vertically. Substantially an upper half of the plunger 20 is inserted into the guide hole 11. The guide hole 11 has an upper end open to a pump chamber 13 in the cylinder 10. The plunger 20 has an upper end that is located so as to be opposed to the pump chamber 13. A volume of the pump chamber 13 is increased and decreased by forward and rearward movements of the plunger 20.

Figure 5:
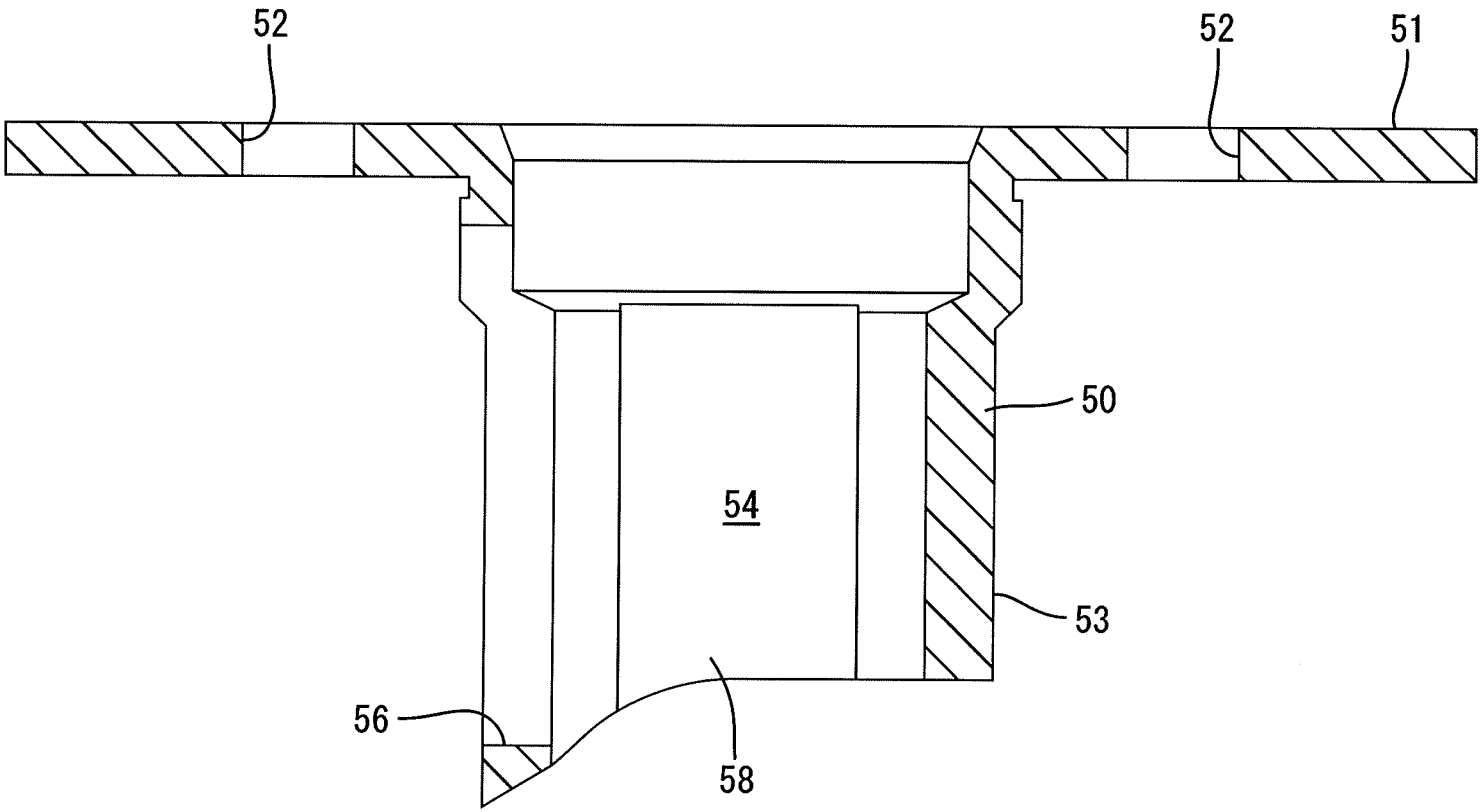
FIG. 5 is a sectional view of the lifter guide.

The lifter guide 50 includes a cylindrical lifter guide body 53 and a flange 51 extending outward from an upper edge of the lifter guide body 53 as shown in FIG. 5. The flange 51 is formed with a pair of right and left through holes 52 for bolts 130. The lifter guide body 53 has a vertically extending bore 54 formed therethrough. A shape of the bore 54 (an inner surface shape of the lifter guide body 53) will be described later.

Figure 2:
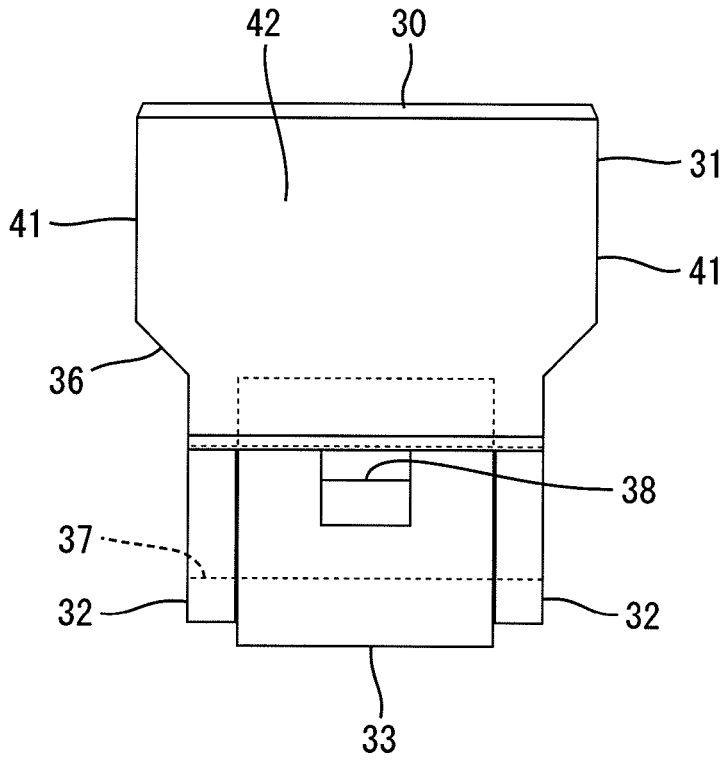
FIG. 2 is a side view of the lifter.
Figure 3:
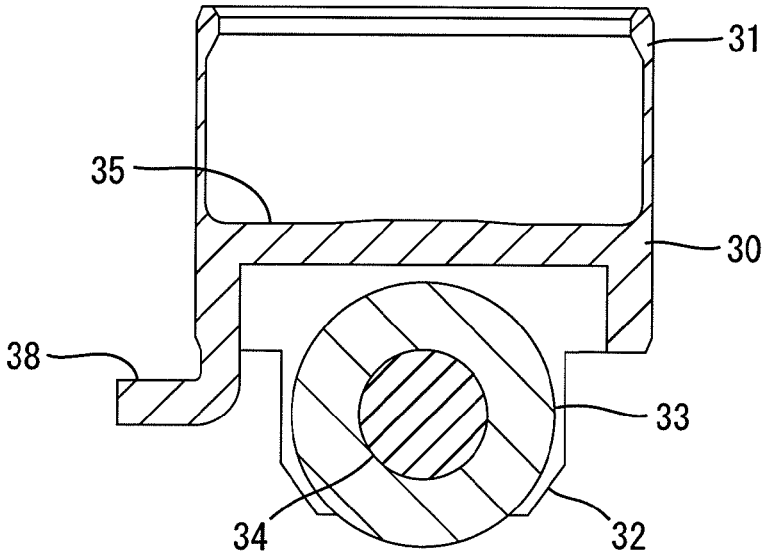
FIG. 3 is a sectional view of the lifter.

Referring to FIGS. 2 and 3, the lifter 30 includes a cylindrical lifter body 31, a pair of opposed walls 32 continuous to a lower end of the lifter body 31, a roller 33 accommodated between the opposed walls 32, and a pin 34 supporting the roller 33 so that the roller 33 is rotatable about the pin 34. The lifter body 31 is slidably inserted into the bore 54 (an inner circumferential surface of the lifter guide 50). A cam 160 formed in a cam shaft of the engine (not shown) is disposed below the roller 33. The roller 33 has an outer circumferential surface that is in abutment with a cam face of the cam 160. The lifter body 31 has a lower end formed with a support plate 35. An interior of the lifter body 31 is closed by the support plate 35, that is, the support plate 35 serves as a bottom of the lifter body 31.

The plunger 20 has a lower end with which a retainer 90 is integrally formed. The lower end of the plunger 20 protrudes out of the lower end of the cylinder, facing the interior of the lifter body 31. The lower end of the plunger 20 is further in abutment with an upper surface of the support plate 35. A coil spring 80 is provided between the retainer 90 and the spring seat 70. The lifter 30 and the plunger 20 are biased to the cam 160 side by the coil spring 80.

The above-described lifter structure will work as follows. Upon rotation of the cam shaft by the engine, the roller 33 rolls on the cam face of the rotating cam 160. With this, the lifter 30 is reciprocated in the up-down direction in the lifter guide 50 and the coil spring 80 repeats a telescopic movement. As a result, the plunger 20 is reciprocated in the up-down direction in the guide hole 11 together with the lifter 30, whereby the volume of the pump 13 is increased and decreased such that the fuel is sucked and discharged.

The lifter 30 and the peripheral structure will now be described in more detail. The pin 34 is formed into the shape of an axially elongated column. The roller 33 is cylindrical and rotatable about an axis of the pin 34 extending through the interior thereof. Both opposed walls 32 are each formed into the shape of a flat plate extending in the up-down direction, protruding from the lower end of the lifter body 31 substantially in parallel with each other. The lower end of the lifter body 31 is formed with a connection 36 having a width that is gradually reduced toward a proximal end of the opposed walls 32. The connection 36 is continuous to both opposed walls 32.

The opposed walls 32 are formed with holes 37 through which both ends of the pin 34 extend respectively. The pin 34 is thus inserted through the holes 37 and fixed such that the roller 33 is supported via the pin 34 on the opposed walls 32. The axes of the pin 34 and the cam 160 are substantially in parallel to each other and extend in the same direction as the thicknesses of the opposed walls 32. Furthermore, the lower end of the lifter body 31 is formed with a protrusion 38 which protrudes outward. The lifter guide body 53 has a retaining groove 56 which is located so as to correspond to the protrusion 38. The retaining groove 56 extends through the lifter guide body 53 in the direction of thickness of the lifter guide body 53. The retaining groove 56 extends in the up-down direction at least by a length corresponding to a movement stroke of the lifter 30. The protrusion 38 is fitted into the retaining groove 56 when the lifter 30 is assembled to the lifter guide 50, whereby the lifter is positioned in the circumferential direction. The protrusion 38 is slid on a groove surface of the retaining groove 56 during the movement of the lifter 30, whereby the lifter 30 is prevented from turning in the bore 54.

Both ends of the pin 34 inserted in the holes 37 face the outer surfaces of the opposed walls 32 respectively. A swaging tool (not shown) is applied to the ends of the pin 34 such that the ends are collapsed thereby to be closely adherent around the holes on the outer surfaces of the opposed walls 32 respectively. With the swaging, an inward swaging force is imparted to the opposed walls 32. When the swaging force is excessively large, the opposed walls 32 would be plastically deformed in such a direction that the lower ends of the walls 32 come closer to each other or fall down inward.

Figure 6:
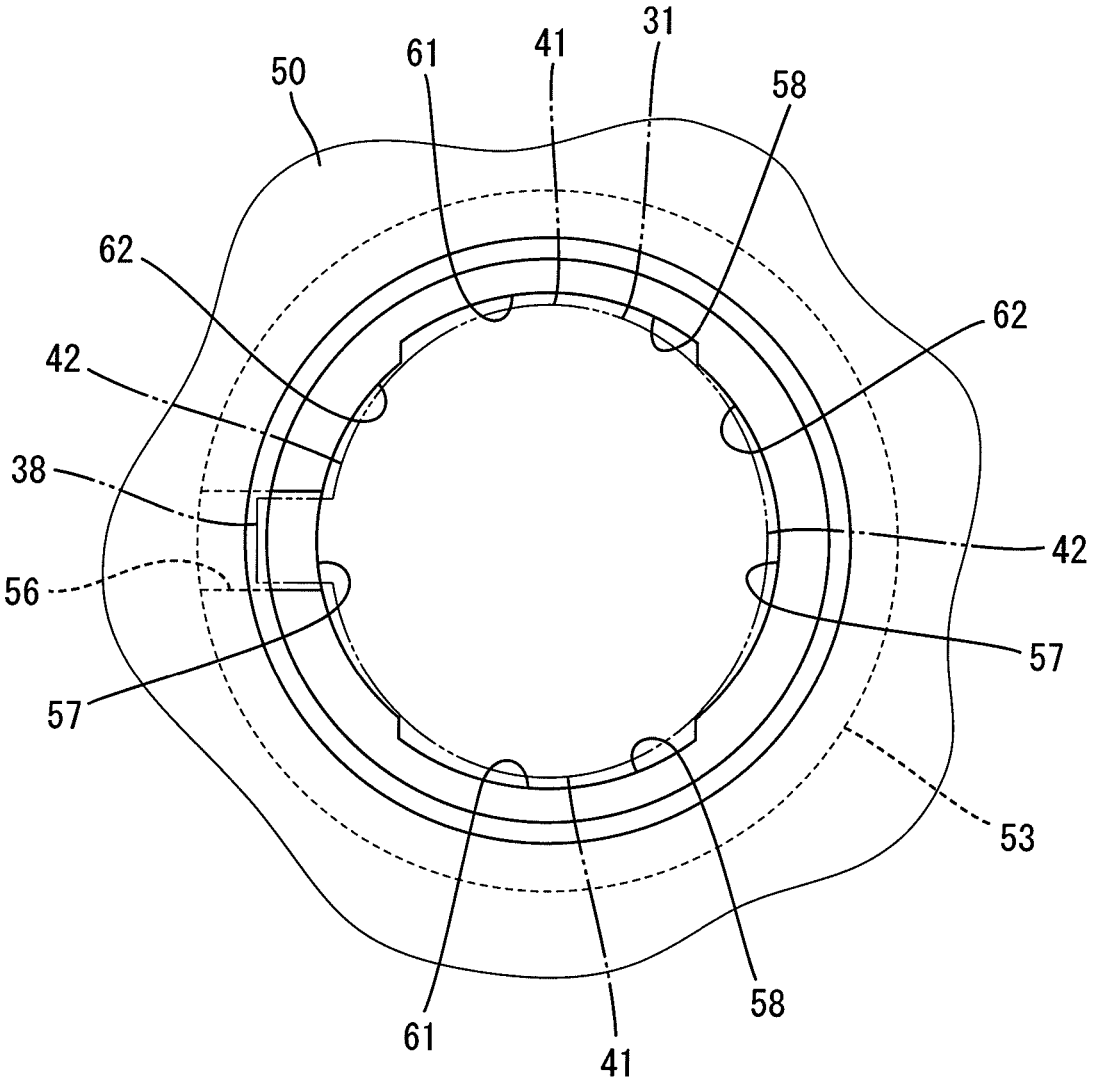
FIG. 6 is an enlarged plan view of the lifter guide into which the lifter is inserted.

The deformation of the opposed walls 32 adversely affects the side of the lifter body 31 continuous to the opposed walls 32. The outer circumferential surface of the lifter body 31 includes two parts located at the same sides as the opposed walls 32 respectively, which will hereinafter be referred to as "swaging side region 41" (see FIG. 6). The swaging side regions 41 are plastically deformed so as to bulge outward from the connection side toward the upper end. In this case, the outer circumferential surface of the lifter body 31 includes two parts located at sides perpendicular to the swaging side region 41 respectively, which will hereinafter be referred to as "non-swaging side region 42." The non-swaging side regions 42 are plastically deformed so as to be dented inward due to the deformation of the swaging side region 41. As a result, the outer circumferential surface of the lifter body 31 is slightly extended in a direction parallel to an axial direction of the pin 34, presenting a substantially oval shape.

Figure 4:
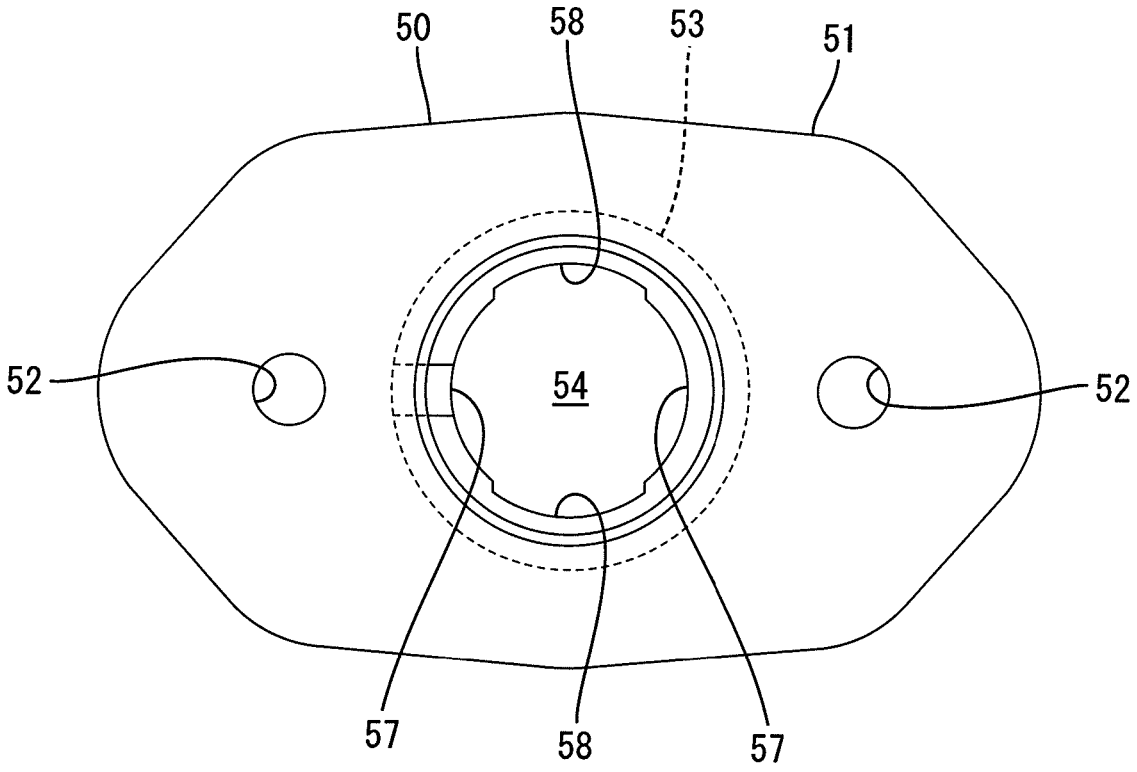
FIG. 4 is a plan view of the lifter guide.

On the other hand, the bore 54 has a main hole 57 having a substantially true circular shape and a pair of auxiliary holes 58 formed by radially outwardly recessing the circumferential wall at radial ends of the main hole 57, as shown in FIG. 4. The main hole 57 has a diameter corresponding to an outer diameter of the lifter body 31 before the deformation. The lifter body 31 before the deformation or more specifically, the outer circumferential surface of the lifter body 31 before the deformation is slidable on an inner circumferential surface of the main hole 57. The auxiliary holes 58 are formed by cutting out the inner circumferential surface of the lifter guide 50 by a broaching process or the like and extend in the up-down direction at least by a length corresponding to a movement stroke of the lifter 30. Each auxiliary hole 58 has an arc section concentric with the main hole 57.

The lifter guide 50 includes two parts located opposite the swaging side regions 41 respectively when the lifter 30 is positioned and inserted into the bore 54. Both auxiliary holes 58 are located at the parts of the lifter guide 50 respectively. Each aforementioned part of the lifter guide 50 will hereinafter be referred to as "swaging side opposite region 61" (see FIG. 6). The auxiliary holes 58 thus serve as escape recesses spaced from the swaging side regions 41 respectively. Consequently, even if the swaging side regions 41 of the lifter body 31 are deformed due to the swaging process applied to both opposed walls 32, the deformed portions go into the auxiliary holes 58 of the swaging side opposite region 61, whereupon interference is avoided between the swaging side regions 41 and the swaging side opposite regions 61 respectively.

On the other hand, the inner circumferential surface of the lifter guide 50 includes two parts located opposite the non-swaging side regions 42 when the lifter 30 is positioned and inserted into the bore 54. Each aforementioned part of the inner circumferential surface of the lifter guide 50 will hereinafter be referred to as "non-swaging side opposite region 62." Parts of the main hole 57 other than the auxiliary holes 58 are located at the non-swaging side opposite regions 62 respectively. Thus, parts of the main-hole 57 other than the auxiliary holes 58 are disposed nearer the non-swaging side regions 42 while avoiding interference with the non-swaging side regions 42, respectively. In this case, clearances between the non-swaging side regions 42 and the non-swaging side opposite regions 62 are set so as to be smaller than clearances between the swaging side regions 41 and the swaging side opposite regions 61 respectively. The clearances between the non-swaging side regions 42 and the non-swaging side opposite regions 62 include clearances which are located at both lengthwise ends and serve as parts continuous to the swaging side regions 41 and the swaging side opposite regions 61, respectively. The aforementioned clearances between the regions 42 and 62 are set so as to be smallest. The retaining groove 56 is disposed at the lengthwise middle of one of the non-swaging side opposite regions 62 in the inner circumferential surface of the lifter guide 50.

According to the foregoing embodiment, the auxiliary holes (escape recesses) are formed in the swaging side opposite regions 61 in the inner circumferential surface of the lifter guide 50 so as to be spaced from the swaging side regions 41 in the outer circumferential surface of the lifter body 31 respectively. Accordingly, even if the swaging side regions 41 are deformed by the swaging process applied to the opposed wall 32, the deformation is absorbed by the auxiliary holes 58. Consequently, the interference is avoided between the swaging side opposite regions 61 and the swaging side regions 41, whereupon the efficiency can be improved in the assembling of the lifter 30 into the lifter guide 50.

The outer circumferential surface of the lifter body 31 includes the non-swaging side regions 42 located at the sides perpendicular to the swaging side regions 41 respectively. The inner circumferential surface of the lifter guide 50 includes the non-swaging side opposite regions 62 located opposite the non-swaging side regions 42 respectively. The non-swaging side regions 42 and the non-swaging side opposite regions 62 can be maintained in the conventional location relationship. Accordingly, the free motion of the lifter 30 in the bore 54 can be limited without occurrence of large gaps between the regions 42 and 62 respectively. As a result, smooth reciprocation of the lifter 30 can be guaranteed. In this case, since the non-swaging side regions 42 and the non-swaging side opposite regions 62 are located opposite the driving direction of the cam 160 (the rotational direction of the roller 33) respectively, the free motion of the lifter 30 is effectively limited.

Furthermore, the clearances between the non-swaging side opposite regions 62 and the non-swaging side regions 42 are set so as to be smaller than the clearances between the swaging side opposite regions 61 and the swaging side regions 41. Consequently, the free motion of the lifter 30 in the bore 54 can be limited further effectively.

Additionally, the lifter guide 50 has the main hole 57 with the inner part (the bore 54) having the circular section and the paired auxiliary holes 58 which are radially outwardly recessed at the both radial ends of the main hole 57. Consequently, a higher dimensional accuracy can be achieved easily, and the freedom in the forming of the auxiliary holes 58 can be improved.

The foregoing embodiment should not be restrictive but may be modified as follows. The lifter guide body 53 may have a substantially elliptic bore so that radial dimensions between the swaging side opposite regions is longer than radial dimensions between the non-swaging side opposite regions.

The auxiliary holes may have a substantially semicircular section and may be formed into any shape.

Both opposed walls may not protrude individually. A square frame-like peripheral wall may be formed on the end of the lifter body, and two opposed side walls may serve as the opposed walls.

The above-described lifter structure for the fuel pump should not be restrictive. The lifter structure may be widely applied to general valve gear mechanisms in which pins are swaged onto the lifter thereby to support a roller.

The foregoing description and drawings are merely illustrative of the principles and are not to be construed in a limiting sense. Various changes and modifications will become apparent to those of ordinary skill in the art. All such changes and modifications are seen to fall within the scope as defined by the appended claims.

What is claimed is:

1. A lifter structure configured for use in an internal combustion engine, and for actuation by a cam, comprising:

a cylindrical lifter guide;

a lifter body which is reciprocally moveable in the lifter guide while sliding on an inner circumferential surface of the lifter guide, with drive of the cam;

a pair of opposed walls which are continuous to an end of the lifter body and have respective through holes;

a pin extending through the through holes of the opposed walls and having two ends swaged onto outer surfaces of the opposed walls respectively;

a roller which is disposed between the opposed walls so as to be rotatable about the pin with drive of the cam while being in abutment with the cam;

a plurality of swaging side regions that are located at the same sides of an outer circumferential surface of the lifter body as the outer surfaces of the opposed walls respectively;

a plurality of swaging side opposite regions defined in the inner circumferential surface of the lifter guide that are located opposite the swaging side regions; and a plurality of escape recesses which are formed in the swaging side opposite regions so as to be spaced from the swaging side regions respectively.

2. The lifter structure according to claim 1, further comprising a plurality of non-swaging side regions located at sides perpendicular to the swaging side regions of the outer circumferential surface of the lifter body respectively, and a plurality of non-swaging side opposite regions defined in the inner circumferential surface of the lifter guide so as to be located opposite the non-swaging side regions respectively, wherein first clearances are defined between the non-swaging side regions and the non-swaging side opposite regions respectively, and second clearances are defined between the swaging side opposite regions and the swaging side regions respectively, the first clearances being set so as to be smaller than the second clearances.

3. The lifter structure according to claim 2, wherein the first clearances include lengthwise ends continuous to both the swaging side opposite regions and the swaging side regions respectively, said lengthwise ends defining smallest clearances in the first clearances respectively.

4. The lifter structure according to claim 1, wherein the lifter guide has an interior defining a main hole having a substantially circular section and a pair of auxiliary holes which are recessed outward in opposing radial directions from the main hole, the auxiliary holes constituting escape recesses.

5. The lifter structure according to claim 4, wherein the auxiliary holes have arc sections concentric with the main hole respectively.

6. The lifter structure according to claim 4, wherein the auxiliary holes are formed so as to extend at least by a length corresponding to a movement stroke of the lifter body.

7. The lifter structure according to claim 1, further comprising a cylinder which is connected to the lifter guide, the cylinder having an interior through which a guide hole extends and a pump chamber, and a plunger which is inserted into the guide hole and has a first end which confronts the pump chamber and a second end which abuts the lifter body, wherein said first end of the plunger is moved forward and backward in the pump chamber when the lifter body is reciprocated, whereby a volume of the pump chamber is increased or decreased.

8. The lifter structure according to claim 1, wherein the opposed walls are formed into shapes of two flat plates protruding from the ends of the lifter body in parallel to each other.

9. The lifter structure according to claim 8, wherein the ends of the lifter body are formed with connections having widths gradually reduced toward a proximal end of the opposed walls respectively.

10. The lifter structure according to claim 1, wherein the lifter body has a protrusion which protrudes outward, and the inner circumferential surface of the lifter guide has a retaining groove into which the protrusion of the lifter body is fitted, the retaining groove extends in the inner circumferential surface of the lifter guide at least by a length corresponding to a movement stroke of the lifter body.

11. The lifter structure according to claim 10, further comprising a plurality of non-swaging side regions located at sides perpendicular to the swaging side regions of the outer circumferential surface of the lifter body respectively, and a plurality of non-swaging side opposite regions defined in the inner circumferential surface of the lifter guide so as to be located opposite the non-swaging side regions respectively, wherein retaining groove is located at a lengthwise middle of a non-swaging side opposite region in the inner circumferential surface of the lifter guide.

12. The lifter structure according to claim 1, wherein the outer circumferential surface of the lifter body is formed with a substantially oval shaped cross-section having a major radius that extends in parallel to an axial direction of the pin.

* * * * *